US008950656B2

(12) United States Patent
Nebeker et al.

(10) Patent No.: US 8,950,656 B2
(45) **Date of Patent: *Feb. 10, 2015**

(54) GIFT BOXING AND PACKAGING APPARATUS AND METHOD

(76) Inventors: Michael Smith Nebeker, Sandy, UT (US); Barton J. Seliger, Orem, UT (US); Myla B. Thorn, Orem, UT (US); Ashton J. Seliger, Orem, UT (US)

( * ) Notice: Subject to any disclaimer, the term of this patent is extended or adjusted under 35 U.S.C. 154(b) by 340 days.

This patent is subject to a terminal disclaimer.

(21) Appl. No.: 13/334,555

(22) Filed: Dec. 22, 2011

(65) Prior Publication Data

US 2013/0161377 A1 Jun. 27, 2013

(51) Int. Cl.

| | |
|---|---|
| ***B65D 5/42*** | (2006.01) |
| ***B31B 1/90*** | (2006.01) |
| ***B31B 1/78*** | (2006.01) |
| ***B65D 5/66*** | (2006.01) |
| ***B31B 1/26*** | (2006.01) |

(52) U.S. Cl.

USPC ..... 229/116.5; 229/122.32; 229/162.1; 220/62

(58) Field of Classification Search

CPC ..... B65D 5/3664; B65D 2571/00549; B65D 5/248; B65D 5/36; B65D 5/4216; B65D 5/6664

USPC ..... 229/116.5, 141, 125, 117.04, 103.3, 229/108.1, 120.21, 147; 493/122, 1; 206/45.2, 45.21

See application file for complete search history.

(56) References Cited

U.S. PATENT DOCUMENTS

| | | | | |
|---|---|---|---|---|
| 5,445,314 | A * | 8/1995 | Newsome | 229/120.21 |
| 6,155,479 | A * | 12/2000 | Wellner et al. | 229/117.08 |
| 6,604,674 | B1 * | 8/2003 | Bowman | 229/116.5 |
| 6,752,311 | B2 * | 6/2004 | Tulkoff | 229/104 |
| 7,481,355 | B2 | 1/2009 | Hui | |
| 2004/0140345 | A1 | 7/2004 | Kao | |
| 2005/0279816 | A1 | 12/2005 | Kao | |
| 2009/0154844 | A1 * | 6/2009 | Greenberg | 383/64 |
| 2010/0314436 | A1 * | 12/2010 | Tao | 229/122.24 |

* cited by examiner

*Primary Examiner* — Christopher Demeree
(74) *Attorney, Agent, or Firm* — Pate Baird, PLLC

(57) ABSTRACT

A gift box for gift cards provides a presentation appearing like a gift box for other products, such as jewelry, having strength, three full dimensions, color, quality, and design options. It can receive decorations such as ribbons and bows, greeting cards such as a to/from card, and the like. The box requires no assembly of components, as it comes in a single, integrated whole, including all the parts of the box and its lid, as well as an interior panel presenting the gift, such as a gift card that operates as a debit card with a pre-loaded amount of purchasing value.

19 Claims, 10 Drawing Sheets

GIFT BOXING AND PACKAGING APPARATUS AND METHOD

BACKGROUND

1. The Field of the Invention

This invention relates to gift wrapping and packaging and, more particularly, to novel systems and methods for gift boxing.

2. The Background Art

Packaging is a multibillion dollar industry. Just as shipping of products is essential to the manufacture and distribution thereof, packaging is likewise an integral part of the distribution of goods.

Within packaging, the concept of gift packaging forms the basis for an entire industry within the packaging business. Gift packaging has various mechanisms including boxing, wrapping, bagging, and so forth. Nevertheless, a new type of gifting has given rise to a lack within the gift box or gift packaging industry. Gift cards are becoming a major portion of the gifting industry.

For example, individuals often desire to provide to a receiver a gift value that is selected by the giver. At the same time, the giver desires to represent to the receiver that some amount of thought and appreciation for the interest of the receiver have been considered. Thus, a gift card for a particular store may be given. In other instances, the gift is simply a gift of money and may be given as a gift card that operates as a debit card from a provider, such as one of the major credit card companies, including Visa, Mastercard, American Express, and so forth.

Presentation is important in sales. In gifting, if "it is the thought that counts," then the presentation of the gift in an envelope, on a card, or the like seems to detract. Thus, is there any suitable way to present a gift card as a gift with a presentation as effective as that of any other gift?

Moreover, manufacturing, distributing, selling, assembling, and otherwise seeing some type of wrapping or gift presentation packaging through to the end consumer who is a giver of a gift card seems to involve many more questions and problems. It would be an advance in the art to provide a suitable gift box that provides for the nature of gift cards or gifted debit cards, while also reflecting gift packaging of traditional gifts and while accommodating the realities of modern retail display, sales transactions, and so forth.

BRIEF SUMMARY OF THE INVENTION

In view of the foregoing, in accordance with the invention as embodied and broadly described herein, a method and apparatus are disclosed in one embodiment of the present invention as including a gift box providing a base with a lid that opens and closes as a box having durable sides, floor, and lid, with proper securement, decoration, and the like. In certain embodiments, a gift box in accordance with the invention may be folded down to a packaging envelope ("envelope" meaning the overall volumetric and dimensional extent in all three dimensions) that is consistent with marketing of gift cards themselves.

For example, security in credit cards is an issue. No less so, gift cards, representing cash value, have become the subject of various fraudulent enterprises. As a result, protecting against stolen cards, fraudulent removal of card numbers, with subsequent theft of funds eventually applied to such cards, and so forth need to be avoided. Thus, retail packaging of gift cards on sealed, cardboard substrates has become more prevalent. Accordingly, gift cards are often presented now in a racking system that provides a certain standard size and shape for the cards.

Accordingly, in certain embodiments of an apparatus and method in accordance with the invention, a foldable gift box provides for a stowed or folded configuration of a box that has a completely manufactured and integrally connected set of components assembled but not erected, and therefore not finally "converted." Thus, the box may be folded into a suitable presentation sized to fit within the spatial envelope available on the rack of a gift card sales display.

Meanwhile, the box may be opened and finally converted or erected, since all the parts are already formed and connected permanently to one another. Decisions and movements are minimized in order to provide a fold-up box that provides substantial size in all three dimensions, a suitable gifting presentation, and is configured to hold and present a gift card, gift debit card, or the like.

In certain embodiments an apparatus may be formed as a collapsible gift box comprising a base having a floor with walls, including front, back, and left and right side walls. Walls may be permanently secured thereto and foldable between a first, stowed, position substantially parallel to the floor and a second, deployed, position substantially orthogonal thereto.

A lid is foldable with respect to the walls between a first position parallel thereto, a second position extending away from the floor, and a third position substantially parallel to the floor, and adjacent and perpendicular to the walls. A closure extends from the edge of the lid and is foldable with respect to the lid between a first, open, position parallel to the lid and a second, closed, position substantially orthogonal to the lid. It may be secured to another wall of the walls, such as the front wall.

A panel, presenting the gift inside the box is folded to have an anchor flap, a tuck flap, and a deck between them. The deck is pivotable with respect to the anchor flap and the tuck flap. The anchor flap is typically permanently secured to an anchor wall (usually selected from either the front or back walls).

The tuck flap folds from a stowed position parallel to the floor to a deployed position substantially perpendicular to it. The walls, lid, and closure are best formed if integral, continuous, and contiguous with one another in the stowed and the deployed configurations. The walls, lid, and closure are also typically integral, continuous, and contiguous at all positions between the stowed and the deployed configurations.

The anchor flap is best made permanently secured in the stowed position to contact one of the front and back walls, and remains there the deployed position. It requires no further securement materials. The tuck flap is best positioned against the other of the front and back walls when folded into the deployed configuration.

Tabs connect the walls to the floor and to one another in the stowed configuration and the deployed configuration. In fact, the tabs maintain and force the relative positions of all walls in both the stowed and deployed configurations. Therefore, the anchor flap is sometimes permanently captured such that it moves in against one pair of the tabs in the deployed configuration. The tuck flap, meanwhile, is retained against the other pair of the tabs in the deployed configuration. This makes it so that one pair of the tabs is connected to draw the panel toward perpendicularity with the floor upon movement of the walls from the stowed configuration top the deployed configuration.

The tuck flap and the anchor flap are typically sized to incline the deck by extending different depths from the floor and along a height of the walls. A securement on the deck holds a gift (typically a gift card) secured to the deck.

Retail packaging is best formed as a transparent container with a hanger tag or header secured as a closure. The retail packaging also is well suited if matched to the dimensions of the packaging "envelope" (width, height, thickness) of the retail packaging for a gift card or other gift to be displayed in the same display, sold at the same time, and secured to the deck for gift giving.

A method for constructing a gift box may include providing a box, having walls, comprising a front wall, back wall, left wall, and right wall, and a floor, all permanently attached to one another in a first, stowed, configuration and a second, deployed configuration. A lid may be pivotably and permanently attached to the back wall to fold between a first position, proximate the floor and parallel thereto, corresponding to the first or stowed configuration. In a second position, the lid is parallel to the floor, spaced away from the floor by the walls. This corresponds to the deployed configuration of the box.

By providing another panel, one can form a deck, an anchor flap, and a tuck flap. The deck is usually made permanently integral with, and foldable with respect to, the anchor flap and tuck flap, from a single piece of material. The panel is secured to the box by securing the anchor flap permanently at, near, or against one of the walls, usually the front wall or back wall.

The deck can be extended parallel to the floor and the lid in the first (stowed) configuration. It and the tuck flap may be moved and folded with respect to one another to present the deck between the walls and spaced from the floor. This corresponds to the second or deployed configuration. Meanwhile, the anchor flap remains integral with the panel and the box. When folding the box into the first configuration, the panel remains integral thereto and contained entirely therein.

In one embodiment, the panel is provided as a monolithic sheet of material. A first fold defines the anchor flap and a hinge line, for pivoting of the anchor flap with respect to the deck. Making a second fold, defines the tuck flap and a tuck hinge line, for pivoting of the tuck flap with respect to the deck.

Securing the anchor flap to the back wall, enables securing the tabs, which act as folding-control tabs (extending from the ends of the side walls) to be secured at their opposite edges to the anchor flap, instead of to the back wall itself.

Sales displays permit displaying the box to a consumer at a point of purchase of gifts, such as gift cards, and even on the same, identical racks as the gift card packages. After selling the box to a consumer, and providing instructions for final conversion of the box, the consumer may erect the box without tools, without attaching or moving the walls independently from one another. Erecting the box does not require adding anything to the box not already integral to it. Erecting the box may be a reversible process from the deployed configuration to the stowed configuration without damaging the box.

Instructions may contain an instruction for erecting the box and closing the lid without separating the walls, floor, lid, or panel at their points of connection to one another. Rather, they describe changing the configuration of the box from the first position to the second position without tools, separation of hinging fold lines, or separation of components from securement to one another.

In some embodiments, a box apparatus may include a floor and walls (front, back, and left and right side walls), permanently secured to the floor. The walls are foldable with respect to the floor. A locking flap is also permanently secured to extend from, and fold with respect to, the front wall.

A lid is permanently connected directly to, and foldable with respect to, the back wall. The entire base structure is foldable between a first, stowed, configuration wherein the walls and lid are substantially parallel to the floor, and a second, deployed, configuration wherein the walls are substantially orthogonal to the floor.

The lid is foldable between a first lid position corresponding to the stowed position, an intermediate lid position, open and extending away from the floor, and a second position corresponding to the deployed configuration, wherein the lid is substantially parallel to and opposite the floor, and sitting on top of the walls, that is, adjacent and perpendicular to the walls;

A panel may be included, and folded to create an anchor flap, a tuck flap, and a deck therebetween. The deck is thus pivotable with respect to the anchor flap and the tuck flap. The panel may have the anchor flap permanently secured to at least one of the front wall and the locking flap, preferably the locking flap. In this embodiment, the tuck flap is foldable from a first position parallel to the floor to a second position substantially perpendicular to it.

Tabs pivotably connect the walls to one another. As all components, they may be formed of a cardboard, pasteboard, plastic, or the like that is stiff, or even rigid. This may be covered with a decorative material, thinner and flexible, to make the stiff components foldable with respect to one another. The tabs have substantially rigid portions, connected by hinge lines or fold lines at all connections. Thus, the tabs force all the walls to move simultaneously between the stowed and deployed configurations.

The locking flap is typically permanently and foldably secured to the anchor flap so it draws the anchor flap toward the floor in the deployed configuration. The deck is typically permanently secured to (or is a part of the same sheet of material as) the anchor flap, and thereby is connected to the locking flap, in the stowed and deployed configurations. The front edge of the deck is secured by the anchor flap (connected to it) near the floor and away from the lid in the deployed configuration. The rear edge of the deck is positioned by the tuck flap (connecting to it) away from the floor and near the lid in the deployed configuration.

Usually, the walls, lid, and closure are best formed to be integral, continuous, and contiguous with one another in the stowed and the deployed configurations, and at all positions between the stowed and the deployed configurations.

The anchor flap is permanently secured in the stowed position to move into contact with one of the front and back walls (usually the front) in the deployed position without any further securement materials therebetween. The tuck flap is positioned against the other of the front and back walls (usually the back) in the deployed configuration.

Tabs are typically configured in two pairs, connecting the walls to one another in the stowed configuration and the deployed configuration. The anchor flap is permanently captured by the tabs, and therefore drawn against one pair of the tabs (usually at the front wall) in the deployed configuration. The tuck flap is folded and tucked, being retained by friction against the other pair of the tabs (usually at the back wall) in the deployed configuration.

One (e.g., the front) pair of the tabs is connected to draw the panel toward perpendicularity with the floor upon movement of the walls from the stowed configuration to the deployed configuration. The tuck flap may then be folded and tucked. The anchor flap are sized to incline the deck by extending different depths from the floor to the deck. A securement positioned on the deck, which is thereby angled on canted to be lower at the front, holds a gift securely to the deck.

Retail packaging may include a container, such as a transparent bag having a header secured to the top as a hanger for racking in a display rack. This entire retail package may be sized to match the retail packaging of a gift, such as a gift card, having its own security containment system and markings displayed. A gift card may even be pre-mounted on the deck and have the box system be its retail packaging. Otherwise, the box and the gift card may have retail packaging matching the same envelope (i.e., height, width, thickness) of containment. If the gift is a gift card, it may be secured to the deck and positioned to be visible through the container (e.g., bag) to a prospective purchaser at the point of purchase.

In one embodiment, a method provides a box, having a floor and walls, each substantially rigid, with the floor and walls all permanently and hingedly connected to one another. A locking flap is provided, extending between a first edge and a second edge. The first edge is hingedly and permanently connected to pivot about the front wall. It has a neutral position, where the second edge is outside the side walls, and a locking position, where the second edge extends between the side walls and runs along the front wall, near the wall and near (or even against) the floor. The box is positionable in a first, stowed, configuration and a second, deployed configuration, without adding parts, subtracting parts, without tools, without cutting, without adding fasteners or components, or the like.

A lid and the walls fold between a first position, at or near the floor and parallel to it (corresponding to the first configuration, stowed), and a second position (corresponding to the deployed configuration), where the walls are substantially perpendicular to the floor and the lid is parallel to the floor, spaced away from the floor by the walls.

The panel has a deck, anchor flap, and tuck flap. These are permanently and integrally secured to be hinged, or foldable. The panel is secured to the box by securing the anchor flap permanently to a wall, such as the back wall, or to a front wall or front locking flap.

Extending the panel parallel to the floor and the lid in the first configuration may hide the deck under the lid and over the folded down walls. When deployed, the lid is spaced from the floor by the walls perpendicular to both. The anchor flap remains integral with the panel and the box, secured to the locking flap, at all times.

At the point of sale, with the box in a transparent retail package (e.g., bag with a hanger) the lid may be positioned in one of two alternative first configurations available. The first alternative first configuration positions the panel under the lid, presenting the lid and the locking flap as representative of the decorative look, design, and color of the box.

The second alternative first configuration positions the panel outside the lid, thus showing the locking flap as representative of the box. In this configuration, the deck and tuck flap extend upward in the packaging to render the deck, its contents, or both visible to a prospective purchaser at the point of purchase. Thus, a gift card may be attached and displayed directly on the deck in the package.

It should be understood that the deck is movable, from this latter configuration, to move with the tuck flap from underneath the lid. After folding the lid back, out of the way, a user may place the deck between the side walls, spaced from the floor, in the second configuration. The anchor flap remains integral with the panel and the box while folding the box into the first configuration and into the second configuration. The box may be reversibly folded between these two configurations repeatedly.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
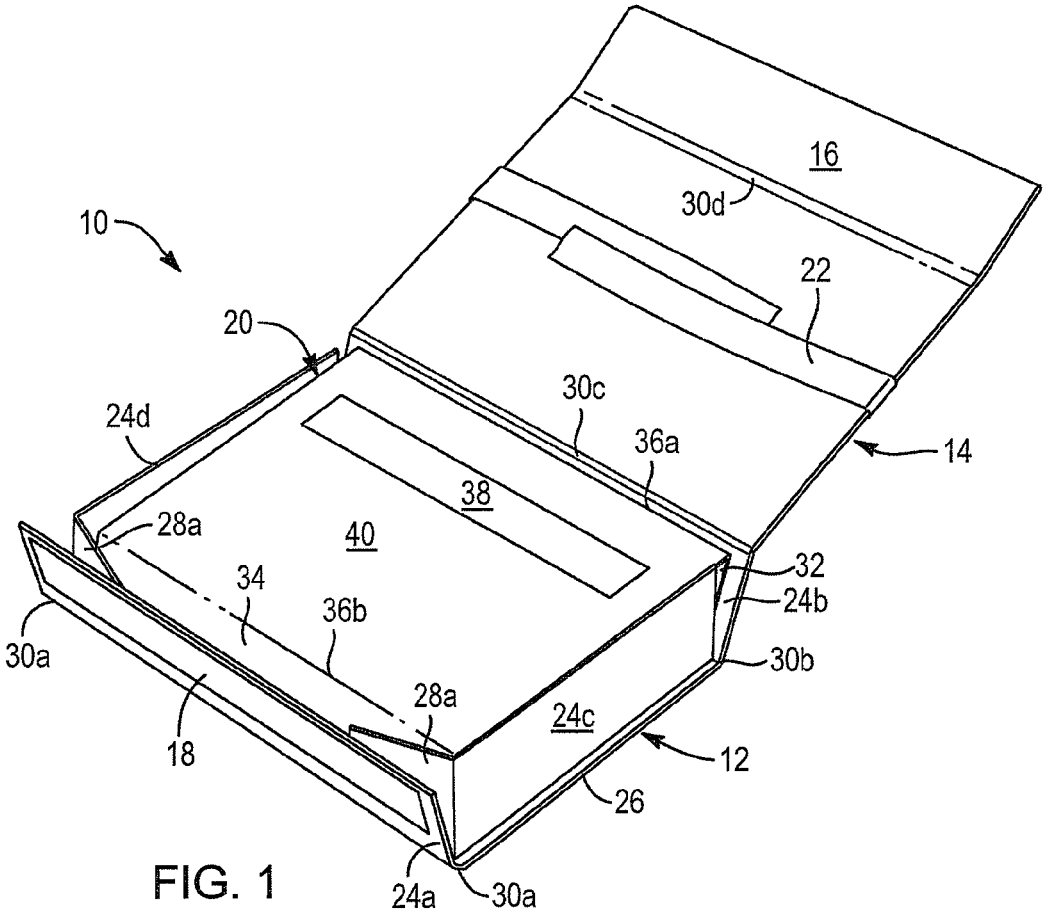
FIG. 1 is a perspective view of one embodiment of a box, in accordance with the invention, almost completely converted, and in a configuration to receive a gift card displayed therein.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1 specifically, and FIGS. 1-14 generally, an apparatus 10 or system 10 for implementing the present invention may include a new box 10 suitable for folding up to a closed configuration or stowed position in order to be shipped, stored, displayed, and sold but which can be constructed, converted, or erected without a need to glue, tape, or otherwise fasten together the basic components. That is, all of the components are fastened together at the time of manufacture such that the entire box 10 may be finally converted by simply moving components or changing their relative positions in order to move the box 10 from a folded up and stowable position to a fully constructed and deployed position.

In the illustrated embodiments of FIGS. 1-14, while continuing to refer specifically to FIGS. 1-10, an apparatus 10 or box 10 may include a base 12 or a base portion 12. The base 12 may be thought of as the eventual open box 12 that forms a part of the overall box 10. For example, to the base 12 is secured a lid 14. The lid 14 may be considered to include a flap 16, or the flap 16 may be considered its own component 16 in addition to the lid 14. By either notation, a lid 14 closes on the open top of a base 12 to form the entire closed box 10.

In certain embodiments, a seal 18 may be positioned between the flap 16 and the base 12 in order to seal the flap 16 to the base 12. As illustrated, the seal 18 is secured to the base 12. Nevertheless, the seal 18 could as easily be secured to the flap 16 in order that the flap 16 may seal upon contact with the base 12.

Typically, a seal 18 may involve a strip of adhesive, which may or may not be positioned on a substrate. In one embodiment, a double-sided adhesive strip may include adhesive product on both sides of a substrate. Thus, upon exposure of one side of the substrate to either the flap 16 or the base 12, that side's adhesive portion will glue or adhere the substrate in place.

An alternative embodiment may rely on magnets to secure the front wall as a seal. Two magnets, or a magnet and iron plate, may be mounted internally or externally to operate as a lock to hold the base 12 in a converted shape.

On the opposite side of the substrate, with the remaining adhesive material, a protective strip may be deployed such that adhesive will not adhere to any other portion of the box 10, including the base 12, the lid 14, or any other portion. Thus, the seal 18 may be positioned during manufacture in order to be used upon removal of the protective strip on the exposed adhesive of the seal 18.

In certain embodiments, a box 10 may be provided with a panel 20 within the base 12 to fit as a presentation panel 20 presenting the gift, typically a gift card or gift debit card 50 as described hereinafter. The panel 20 may actually be constructed to have several different portions. Some portions are secured to the base 12, others to be folded to cover the opening in the base 12. Still others are designed to be tucked in to provide stability and stiffening for the base 12 as an open box before sealing by the lid 14, flap 16, and seal 18 against the base 12.

The box 10 may include decoration 22 of various types. More than one decorative element 22 may be included. For example, the entire outer covering of the box 10 may include a material selected for its decorative qualities. A design, embossing, color, wrap, or the like, or any combination thereof may be included as a decorative element 22 of the box 10.

By the same token, a decoration 22 or decorative element 22 may include a ribbon, a bow, both, another bauble, attachment, fixture, three-dimensional object, toy, or the like. Thus, whether flowers, pictures, constructions, three-dimensional objects, or the like, decoration elements 22 may be added to the box 10 in any appropriate location. In the illustrated embodiments, a decoration 22 may typically be visible outside the lid 14 as a key portion of a decorative presentation of the box 10. A gift tag 23 (e.g., to/from tag 23) may be included with the box 10, with the decoration 22, or otherwise.

In certain contemplated embodiments, the box 10 may be provided with walls 24 pivotably connected to hinge with respect to a floor 26 of the box 10 and each other. That is, the floor 26 forms the bottom 26 of the base 12 and the box 10. The walls 24 in a deployed position fold up substantially parallel against the floor 26. Meanwhile, each of the walls 24 is attached to the floor 26 by a contiguous connection 30 (hinge 30), such as a covering over a cardboard inner structure or the like.

Also, tabs 28 connect the walls 24 to one another in a manner to register the walls 24 with one another. The walls include walls 24*a*, 24*b*, 24*c*, and 24*d*. Thus, in general, to speak of a wall 24 is to speak of any or all of the walls 24*a*-24*d*. Herein, a trailing reference letter after a reference numeral simply reflects a specific instance of the item that is identified by the reference numeral. Thus, it is to be understood herein that a reference numeral refers to any of a particular type of component, while a reference numeral followed by a reference letter will identify a specific instance thereof. The operation of the tabs 28 to push and pull the respective walls 24 with respect to one another between a stowed (folded up) and a standing, deployed, fully constructed, or fully converted condition can be understood by reference to the Figures. Also, U.S. Pat. No. 7,481,355 B2, issued Jan. 27, 2009 to Vanessa Hui and directed to foldable boxes, is incorporated herein by reference in its entirety and provides descriptions of various construction details for foldable boxes, any one of which may be used in whole or in part to form structural elements of the box 10 in accordance with the invention.

Associated with the securement of the walls 24 to the floor 26 is a series of additional folds 30, which may be thought of as fold lines 30 or hinges 30. For example, a front hinge 30*a* and a back hinge 30*b* secure the walls 24*a* 24*b* respectively to the floor 26. Similarly, a hinge 30*c* or fold line 30*c* connects the lid 14 to the back wall 24*b* of the base 12. Similarly, a hinge 30*d* or fold line 30*d* connects the main expanse of the lid 14 to the flap 16 in order that the flap 16 may pivot with respect to the lid 14 in order to effect closure. Similarly, the flap 16 may move with respect to the lid 14 in order to orient the components of the box 10 in a stowed position or a deployed position in accordance with the invention.

The panel 20 may include an anchor flap 32. The anchor flap 32 may simply be an extension of the material of the panel 20, just as a tuck flap 34 may represent an opposite extension region of the panel 20. In general, the anchor flap 32 may be hinged at a fold line 36*a*, while the tuck flap 34 is anchored to the panel 20 at a fold line 36*b*.

In general, the panel 20 may include the entirety of the flaps 32, 34 along with the deck 40 therebetween. The deck 40 may have a securement 38, which may be analogous or identical to the seal 18 that seals the flap 16 to the base 12. In certain embodiments, the securement 38 may secure a gift card 50 to the deck 40 for presentation in the box 10.

In the illustrated embodiments, the anchor flap 32 is secured to the base 12. The anchor flap 32 may be secured to or near the front wall 24*a* or the back wall 24*b*. The operation will be significantly different.

In the illustrated embodiment, an anchor flap 32 or anchor flap portion 32 of the panel 20 is secured to the back wall 24*b* of the base 12 of the box 10. In this position, the panel 20 extends along the lid 14. By folding the anchor flap 32 or anchor flap portion 32 of the panel 20 along the anchor fold line 36*a*, the deck 40 is moved away from the lid 14 and toward the floor 26 of the base 12.

Similarly, by folding the tuck flap 34 along the tuck fold line 36*b* or the tuck hinge 36*b*, the tuck flap 34 may be folded to be inserted parallel to the front wall 24*a*. In certain embodiments, the tuck flap 34 may be folded at the tuck fold line 36*b* upward or downward. If tucked downward, then the tuck flap 34 tends to stand the deck 40 slightly off the floor 26. The distance corresponds to the height of the tuck flap 34. If the tuck flap 34 is folded upward along the tuck fold line 36*b*, then it may be advisable to provide some securement mechanism to hold the tuck flap 34 in position against the front wall 24*a* in the converted configuration.

If the tuck flap 34 is instead folded upward along the tuck fold line 36*b*, then the tuck flap 34 drives the deck 40 at the front of the base 12 toward the floor 26, thus accentuating the incline of the deck 40 upward toward the rear wall 24*b*. If the tuck flap 34 is folded downward with respect to the deck 40, then the walls 24 will hold the panel 20 in place.

Meanwhile, the anchor flap 32 and the tuck flap 34 define, by their dimensions, the inclination of the deck 40 presenting a gift card 50 or other gift in the box 10.

Figure 2:
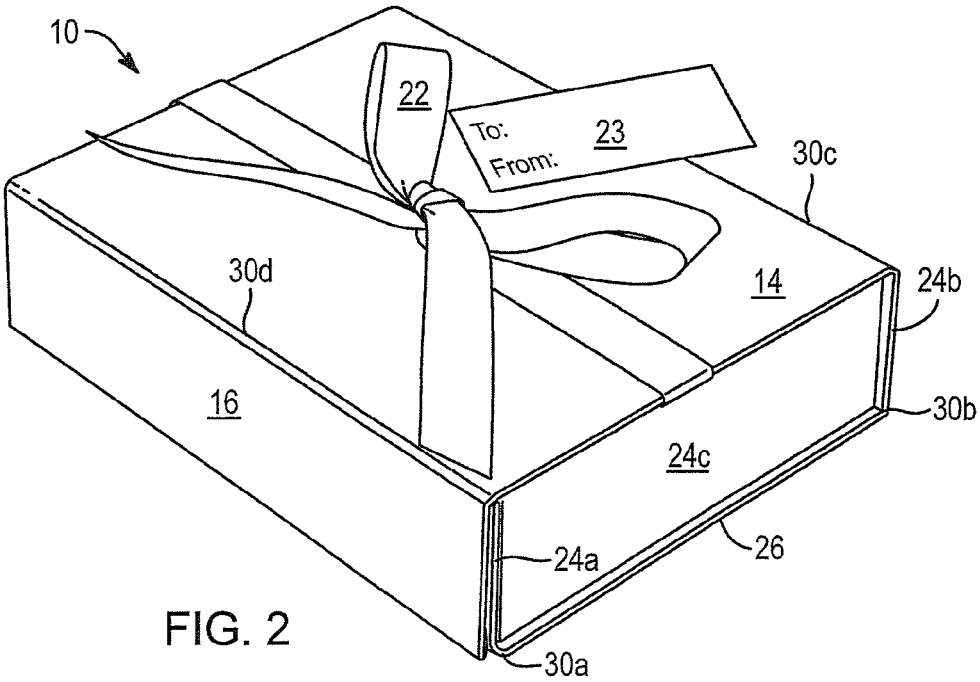
FIG. 2 is a perspective view of the box in FIG. 1 with the lid in a closed position.

Referring to FIG. 2, the box 10 may be seen in a fully converted and closed configuration. In this configuration, the walls 24 are completely converted and positioned orthogonally with respect to the floor 26 and the lid 14. Meanwhile, the flap 16 has been secured to the front wall 24*a* by the seal 18 therebetween. The seal 18 may be formed of any suitable fastener, including adhesive, various types of tape, glue, hook-and-loop fasteners, magnets, a magnet and plate, a tie such as a ribbon or the like, a combination thereof, and so forth.

Figure 3:
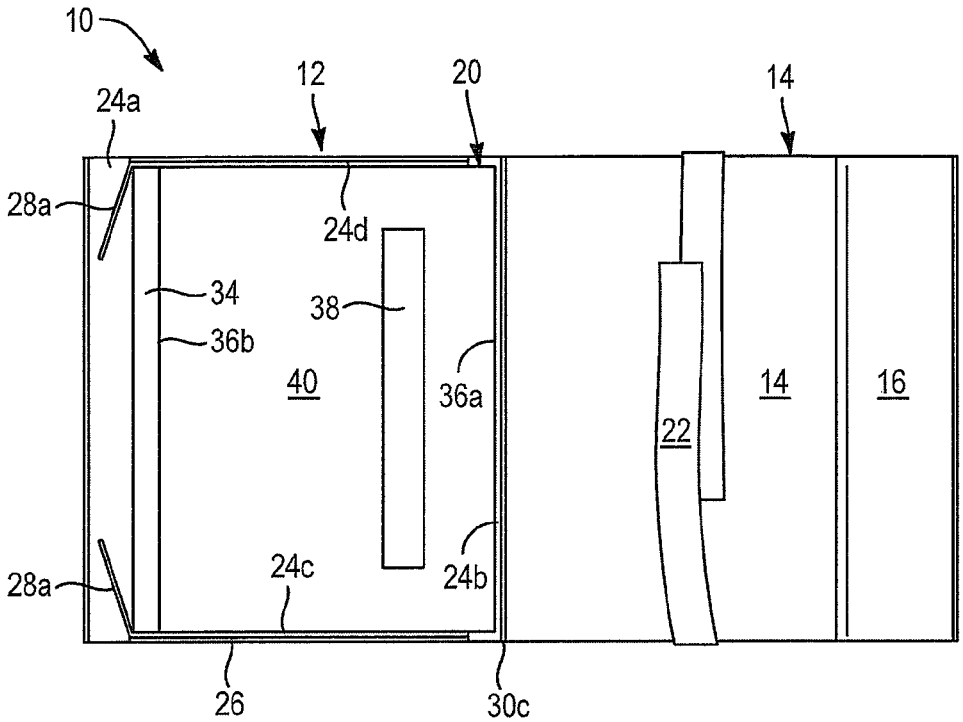
FIG. 3 is a top plan of the view of box of FIG. 1.

Referring to FIG. 3, one can see that the deck 40 presents a securement 38 for adhering a gift card 50 thereto. Meanwhile, the base 12 is not quite an entirely converted configuration in that the walls 24 are not all vertical. In the illustration, one may see the tabs 28 that connect the walls 24. Tabs 28 secure to some at the ends thereof and others on a face, where the tabs 28 (triangles 28) are angled at a 45 degree angle from a corner. This is done in order that the walls 24 may all be laid flat. The tabs 28, during folding down, push the walls 24 apart from one another in order that some walls fold inward and others fold outward to form a flat arrangement of the walls 24, parallel to the floor 26. Likewise, the tabs 28 are in a position to draw the walls 24 together, thus orienting the walls perpendicularly (i.e., orthogonally) to the floor 26 with their own ends snugged up against one another.

Figure 4:
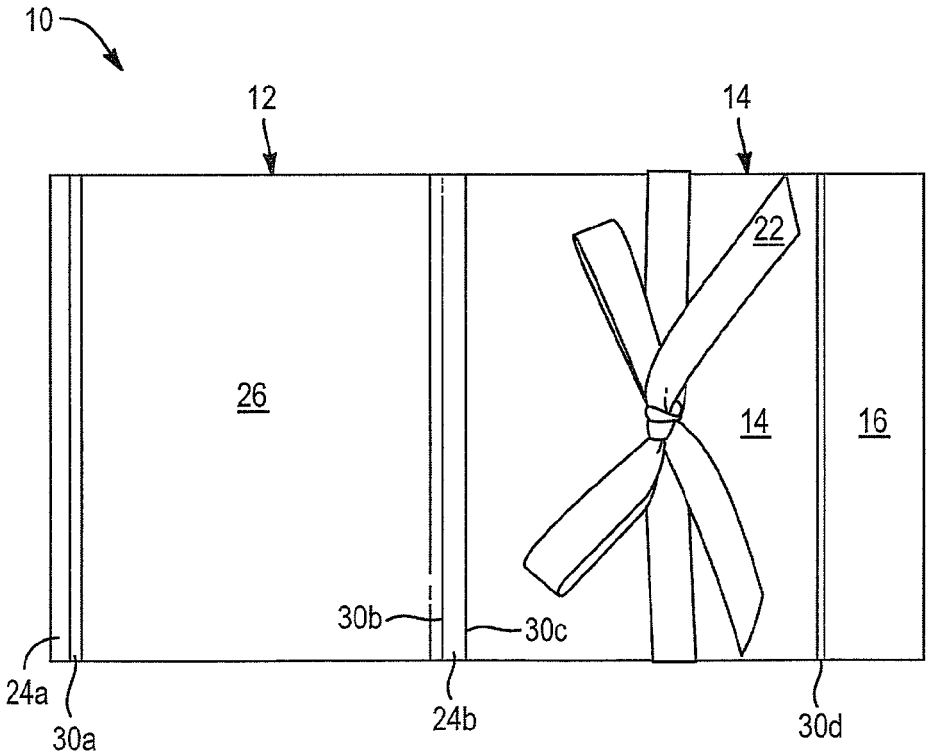
FIG. 4 is a bottom plan of the view of the box of FIG. 1.
Figure 5:
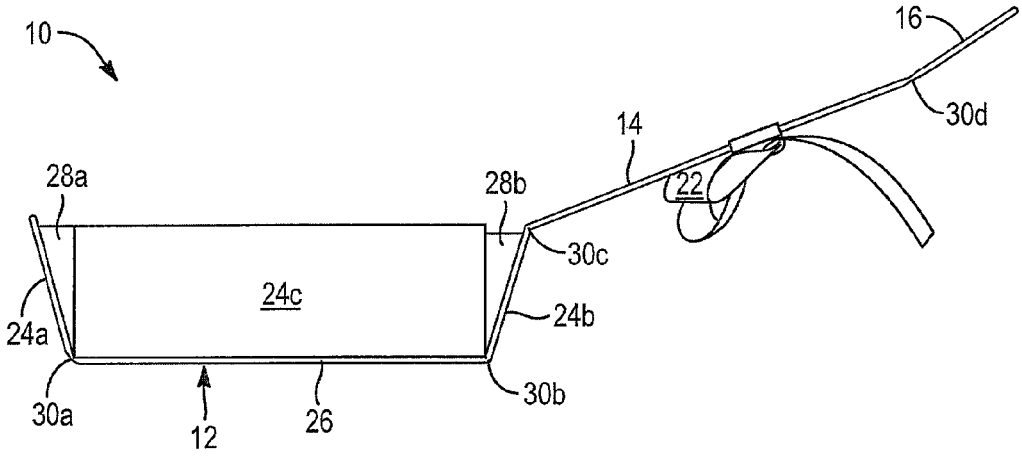
FIG. 5 is a right side elevation view thereof.
Figure 6:
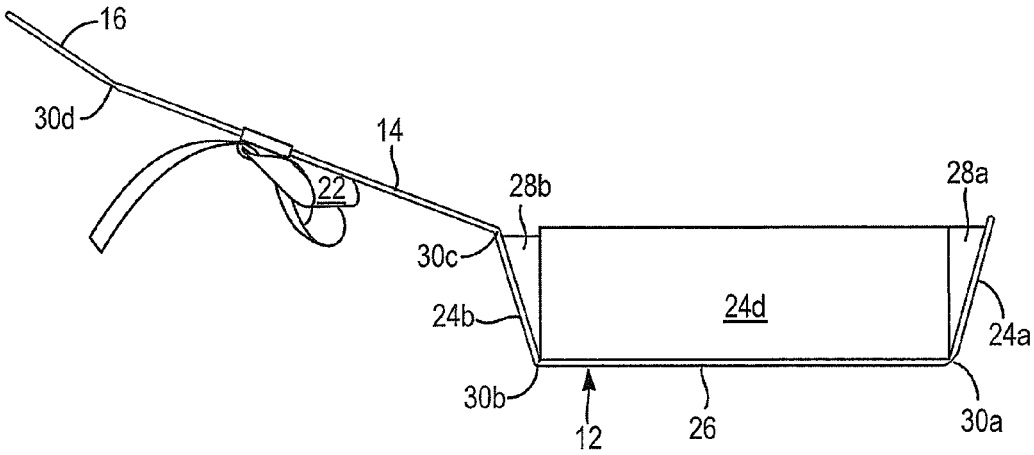
FIG. 6 is a left side elevation view thereof.
Figure 7:
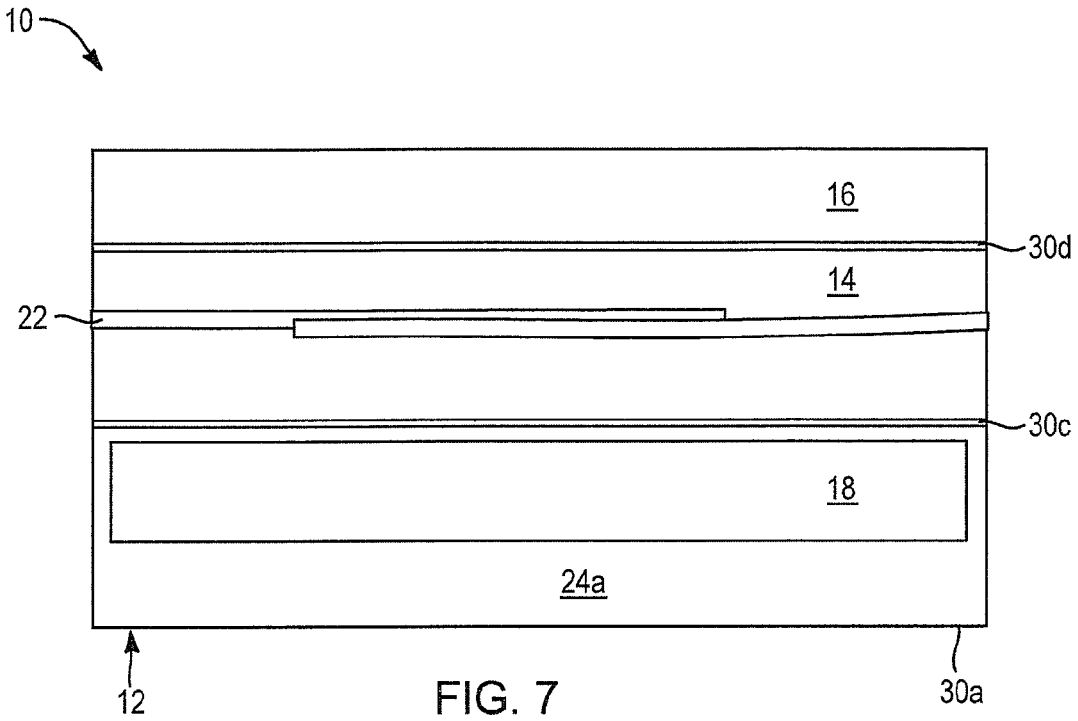
FIG. 7 is a front elevation view thereof.
Figure 8:
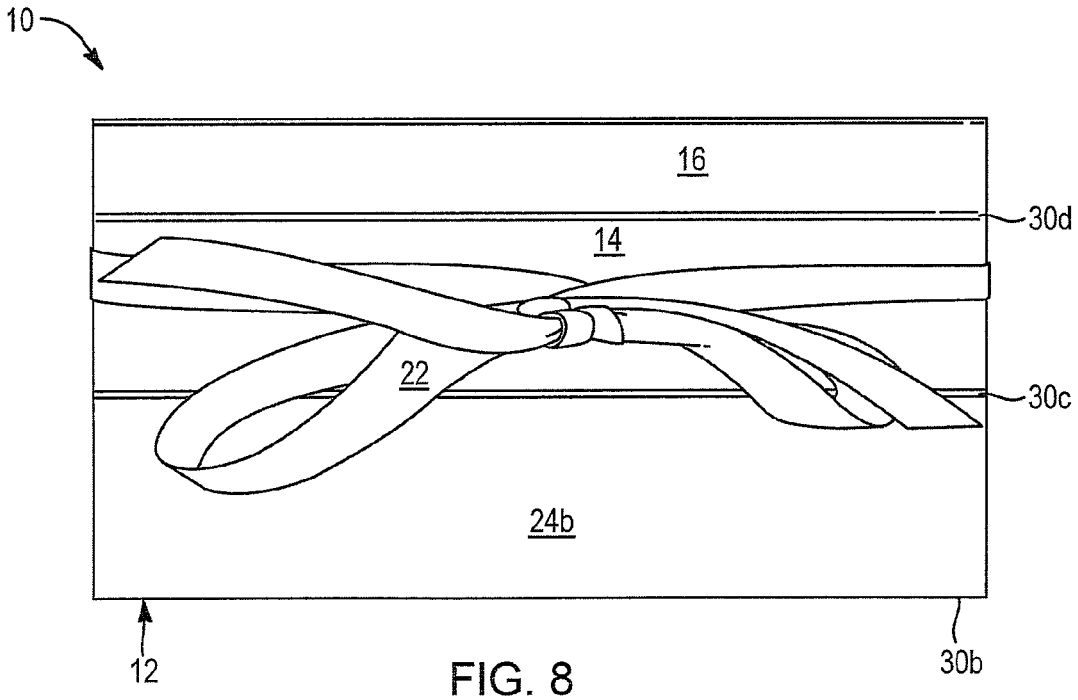
FIG. 8 is a rear elevation view thereof.

Referring to FIG. 4, the bottom plan view of the box 10 shows orientation of the floor 26 and lid 16, as well as the closing flap 16, with the box 10 in an open but almost completely erected or fully converted configuration, ready to receive a gift card 50.

Referring to FIGS. 5-8, the views of the box 10 show the almost completely converted box 10 with the tabs 28 drawing the walls 24 together. Meanwhile, the lid 14 and flap 16 are in an open position, ready to be closed in over the base 12 after the gift card 50 has been positioned on the deck 40 in a suitable presentation.

Figure 9:
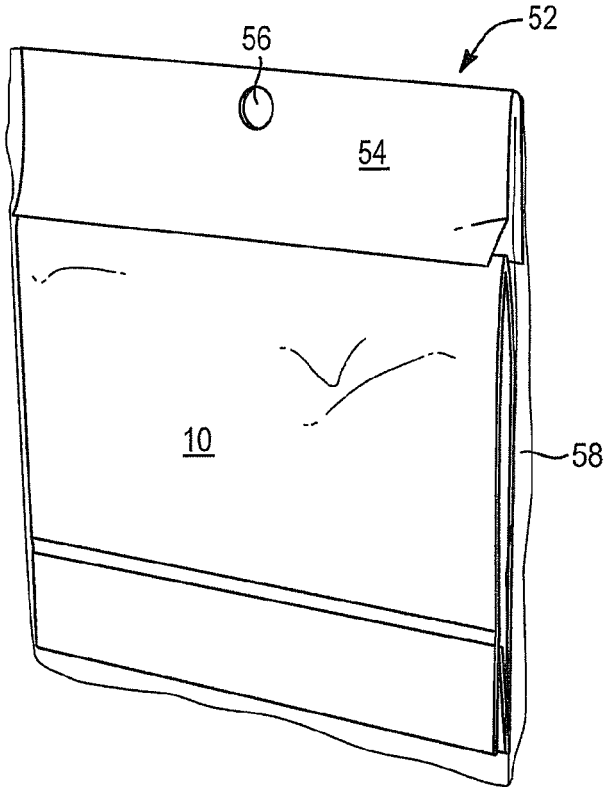
FIG. 9 is a perspective view of one embodiment of a retail packaged box in accordance with the invention, folded up in a stowed position suitable for storage, transport, and sale display.
Figure 10:
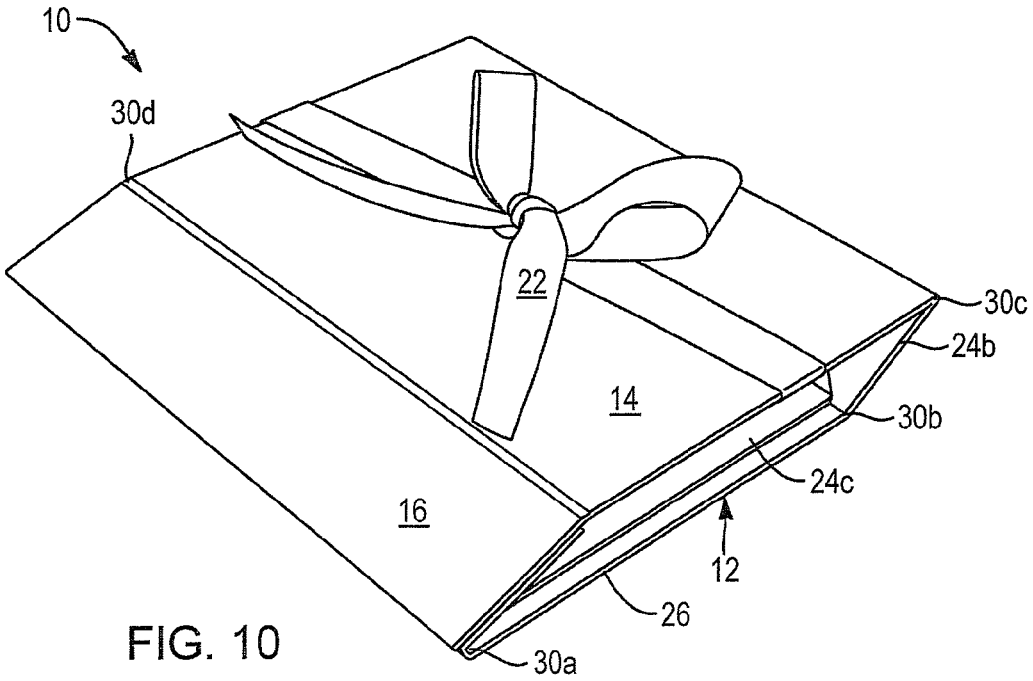
FIG. 10 is a perspective view of the box of FIG. 1 in a substantially folded position, or stowed position, slightly open in order to show the arrangement of the components thereof.

Referring to FIGS. 9-10, the box 10 is presented in a retail package 52 that presents the color scheme of the box 10 to a prospective purchaser. For example, a header 54 or tag 54 may be provided with an aperture 56 suitable to fit on a hanging rack for presentation. Meanwhile, a bag 58 secured to the header 54 or hang tag 54 may be formed of a clear or transparent material in order to present directly the color and decoration scheme of the box 10.

In the illustrated embodiments, the bag 58 or container 58 may be sized to maintain the box 10 collapsed in a stowed position or stowed configuration. Typically, the thicknesses of the box 10 overall, when in the stowed position, is a matter of several thickness of the material of which the box 10 is manufactured. In the illustrated embodiments, the box 10 may be seen through the container 58 or bag 58 in order that the designs, colors, and so forth characteristic of the box 10 may be viewed by a user or prospective purchaser.

Referring to FIG. 10, the box 10 is illustrated slightly open but substantially in the configuration of the stowed position as it will be contained in the bag 58 of the retail packaging 52. The walls 24 may be seen as they are laid flat with the tabs 28, against the floor 26 of the base 12.

Figure 11:
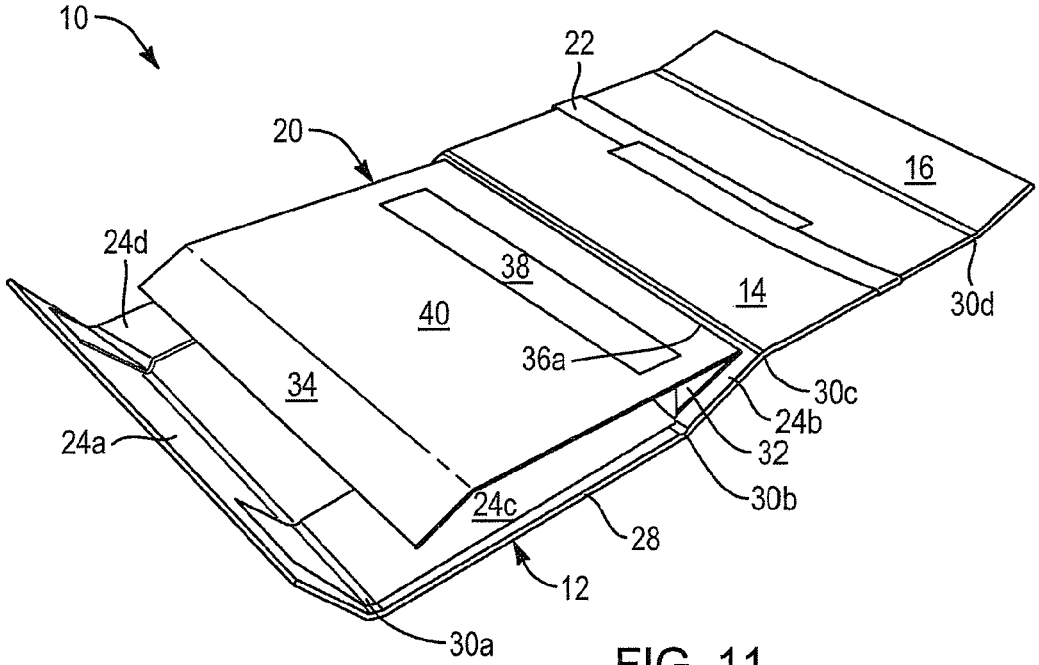
FIG. 11 is a perspective view of the box of FIGS. 1-10, with the box in an open position intermediate the stowed position and the fully converted or fully erected position.
Figure 12:
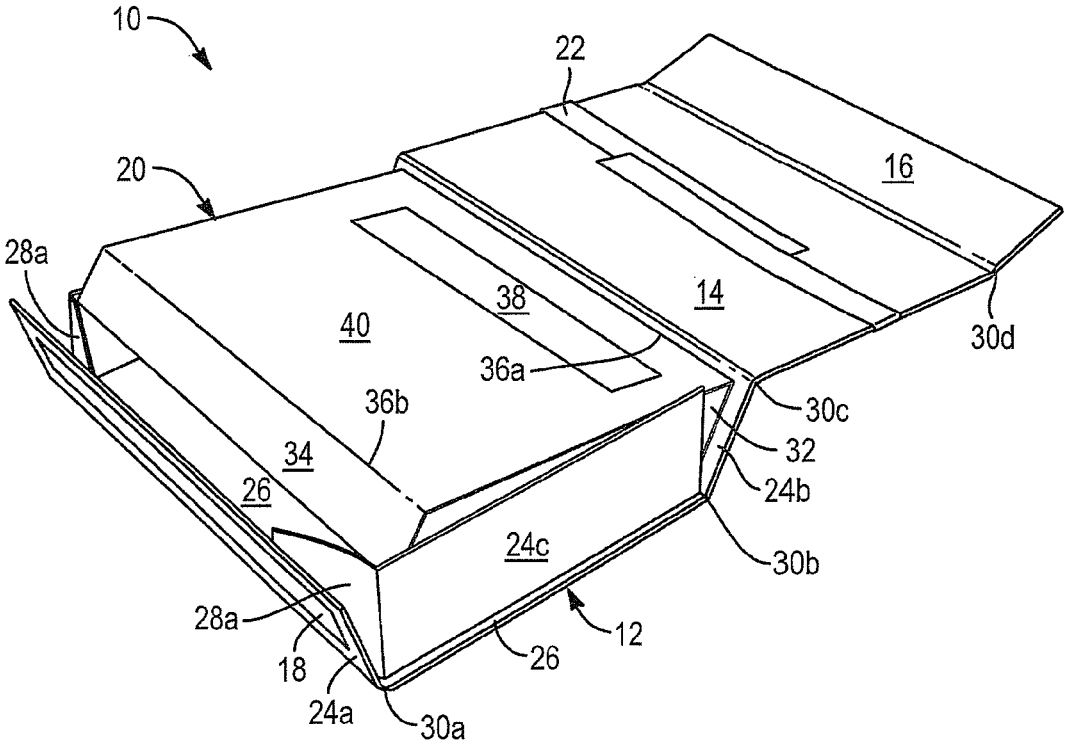
FIG. 12 is a further perspective view of an almost complete conversion configuration thereof.
Figure 13:
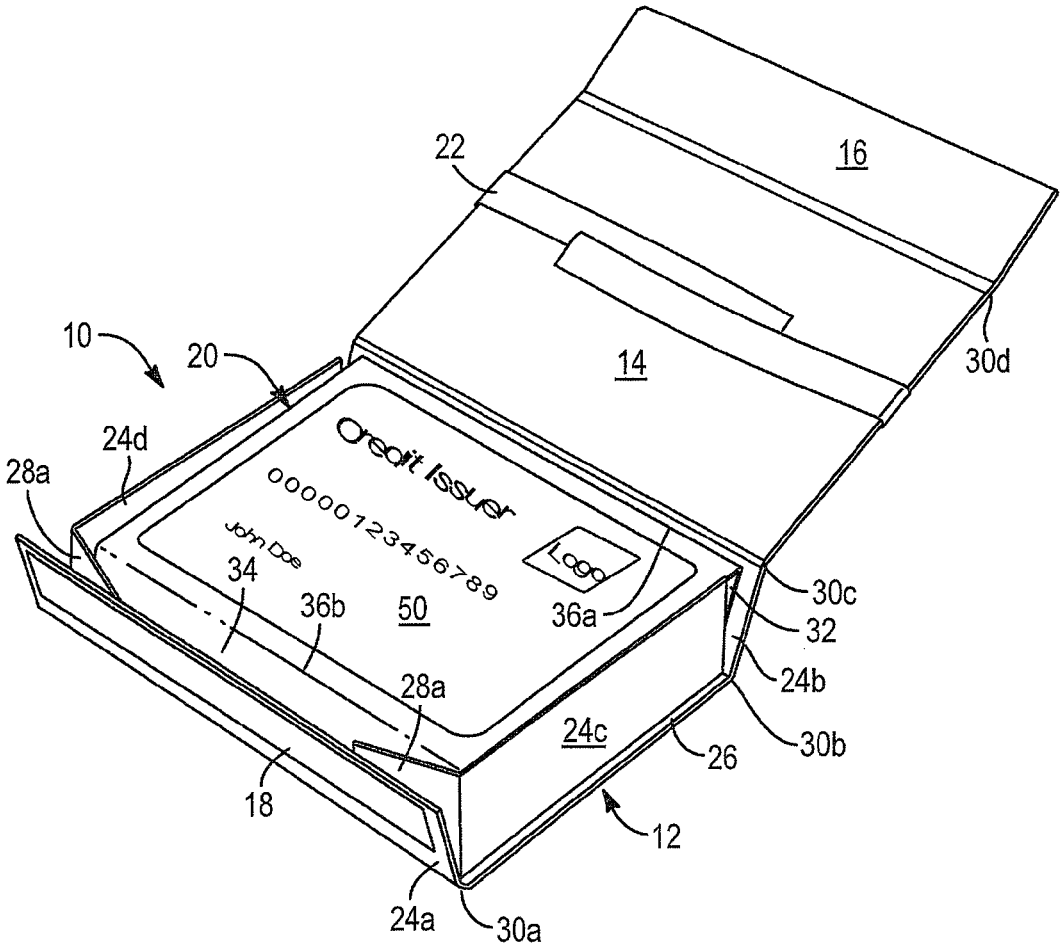
FIG. 13 is an almost completely converted or erected configuration, with the lid still open and the front wall not snugged into place.

Referring to FIGS. 11-13, while continuing to refer generally to FIGS. 1-14, a box 10 in accordance with the invention may be removed from the retail package 52 in order to be converted or finally configured. In the illustrated embodiment, the front wall 24*a* may be folded out away from the floor 26 while the back wall 24*b* is folded out from the floor 24. These components are effectively where they need to be in order for the side walls 24*c*, 24*d* to be drawn apart. Meanwhile, the lid 14 has been opened along its fold line 30*c* in order to expose and position the deck 40 in the proper location for conversion into the interior of the base 12 of the box 10, captured by the walls 24 surrounding it.

Referring to FIG. 13, the deck 40, once the tuck flap 34 has contacted the floor 26 of the box 10, will be in its final position. The height of the tuck flap 34 will determine the angle of incline of the deck 40. Thus, a shorter tuck flap 34 provides a presentation with a steeper incline of the deck 40.

Once the box 10 is fully converted, the gift card 50 may be secured to the securement 38, the lid 14 closed over the top, and the flap 16 secured by the seal 18 against the front wall 24*a*. The folding of the flap 16 over the front wall 24*a* provides securement of the front wall 24*a* and back wall 24*b* to one another, thus ensuring a rigid and strong constitution for the box 10 in the closed configuration. Accordingly, upon closure of the box 10 from the configuration of FIG. 3 to the configuration of FIG. 2, the box 10 is appropriate for gift giving.

Figure 14:
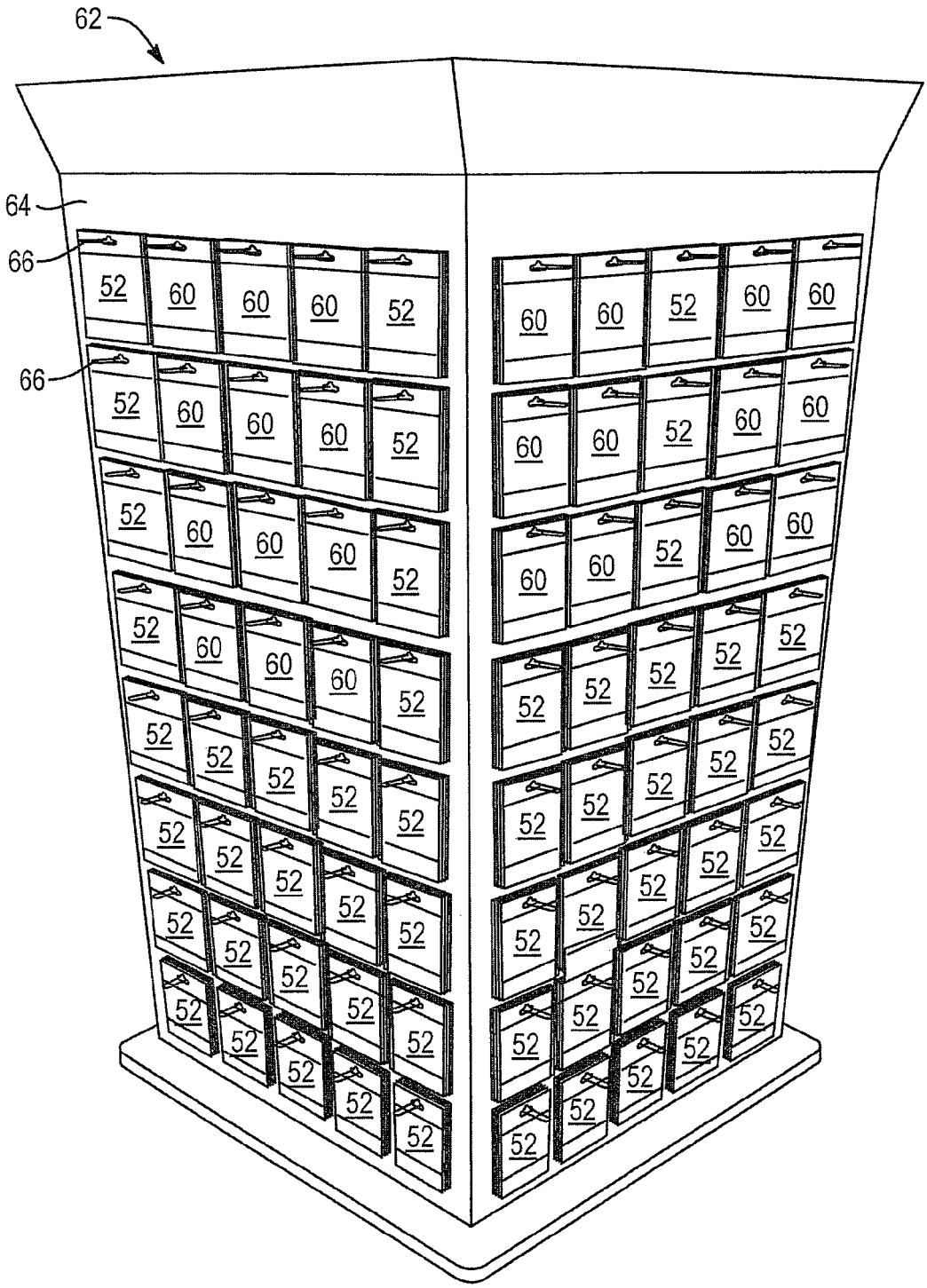
FIG. 14 is a perspective view of one embodiment of a racking system for presenting for sale gift cards and box for use thereof made in accordance with the invention.

Referring to FIG. 14, a retail package 52 may be set up to display with conventional gift card packages 60, including security-carded cards. These latter cards may be enclosed in a sealed package 60 showing little of the card, such as a bar code, or only an image of a gift card 50. Tamper evident sealants completely enclosing all boundaries may prevent or resist unauthorized access. Security in gift cards is the subject of much attention from thieves and card issuers alike. In other instances, the gift card package 60 may simply be a card, container, or the like to which is mounted a gift card 50 that can be activated at a cash register upon checkout.

In the illustrated embodiment, a display 62 includes racks 64 comprising rows and columns of pegs 66, suitable for supporting products hanging therefrom. One configuration of the box 10 in accordance with the invention assures that the entire package 52 fits within the same "envelope" (where "envelope" is used in the sense of the set of three physical dimensions) of a gift card package 60.

The thickness of the retail package 52, or the folded box 10 in the container 58 of the retail packaging 52, may be thicker than the dimension required of gift card packaging 60. Nevertheless, the area, as well as the height and width of the retail package 52, correspond to those of the package 60.

Accordingly, the retail packages 52 containing the gift card boxes 10 in accordance with the invention may be interspersed on alternate columns, may be placed in certain columns, or on certain rows, or may be interspersed with the gift card packages 60. Various configurations are illustrated.

Alternatively, areas or regions of the rack 64 may be devoted to a particular brand of gift card 50, designated by the issuer who will honor the charges made against the gift card 50. Likewise, regions of the rack 64 may be devoted to particular designs, groups of designs, selections of an assortment of designs, and the like for the boxes 10 in accordance with the invention.

A user may select a gift card 50 first, and then select a particular box 10 having a suitable design. On the other hand, a user may instead select the box 10 for suitability for an occasion and then select the gift card 50. In certain configurations, as mentioned already, the gift card 50 and the box 10 may already be configured together, permitting selection of a box 10 of suitable design, which will already be provided with a gift card 50. This may be particularly appropriate where the issuer of the gift card 50 is a credit card company or the like.

For example, gift cards 50 are issued by merchants. A gift card issued by a specific merchant is redeemable only with that merchant, because that merchant is paid at the time that the gift card 50 is purchased. Therefore, no other merchant or financial institution can recognize the gift card 50. In contrast, a credit card issuing company such as Visa, Mastercard, American Express, or the like may issue a gift card 50 that is accepted by most merchants.

Figure 15:
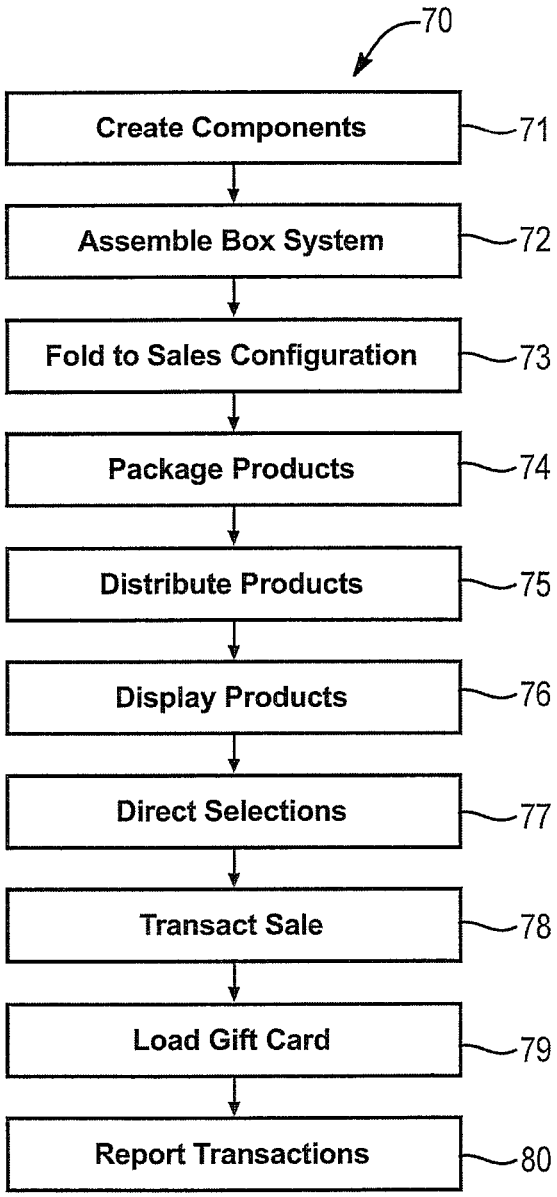
FIG. 15 is a schematic block diagram of a process for making, distributing, and selling boxes in accordance with the invention, along with gift cards that may be presented therein.

Referring to FIG. 15, while continuing to refer generally to FIGS. 1-14, a process 70 in accordance with the invention may begin with creating 71 components for a box 10. The components may then be assembled 72 into a box 10 or a box system 10 as described hereinabove. At the point of manufacture, "constructed" or "assembled" means the fabrication and fastening together of all the components that will make up the box 10. Thus, the complete box 10 may then be folded 73 into a configuration suitable for display and sale.

Packaging 74 the box product 10 or the box 10 with a gift card 50, provides a retail package 52 suitable for distribution 75 and display 76 on a rack 64 in a commercial display 62. In certain embodiments, the printed information on a header 54 or hanger 54 may provide direction 77 of selections to a user. Similarly, space on the rack 64 or the overall display 62 may provide directions 77 to a user directing 77 him or her in making a selection.

For example, a user may need to determine whether to purchase a gift card 50 separately from a box 10, or they may be combined. Likewise, styles, designs, and the like may be coordinated between boxes 10 and gift cards 50. Likewise, a greater number of matches between gift cards 50, and, more specifically, gift cards 50 issued by various merchants, may be found if independent. That is, more cards may be matched up with a greater variety of boxes 10 if the boxes 10 and gift cards 50 are adjacent but separately suspended from the pegs 66 on the rack 64.

After a user completes a selection, the user and seller may then together transact 78 the sale of a gift card 50, a box 10, both individually, or both together in a single retail package 52. Upon payment by a customer for a gift card 50, the loading 79 of a value on the gift card 50 may be consummated by the merchant transacting 78 the sale. For example, certain online transactions may automatically occur between that merchant and issuer of the gift card 50 and other financial institutions.

Ultimately, reporting 80 the transaction 78 will be required in order to communicate the value loaded 79 on the gift card 50, any security information, the merchant transacting 78 the sale, and so forth. In certain embodiments, the gift card 50 may be embedded with information provided exclusively from the issuer. In other embodiments, security codes, identifiers, and the like may also be provided to correspond the gift card 50 with, for example, an individual purchaser, the merchant making the sale or accepting the gift card 50, or the like.

Figure 16:
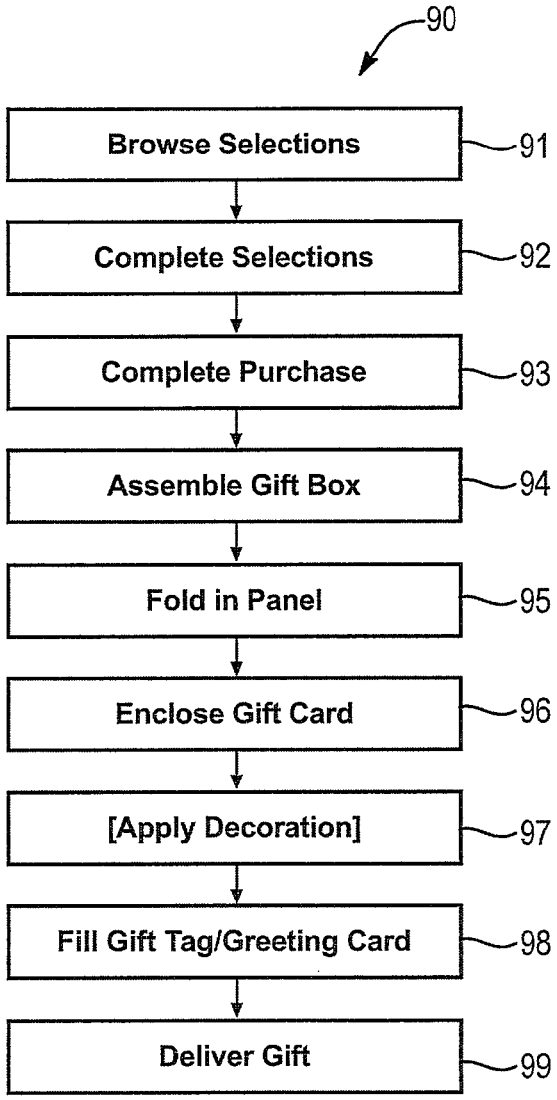
FIG. 16 is a schematic block diagram of one embodiment of a method of using the gift card boxes in accordance with the invention.

Referring to FIG. 16, while continuing to refer generally to FIGS. 1-15, a process 90 for implementing a gift box system 10 in accordance with the invention may begin with browsing 91 by a user or customer of the various selections of boxes 10 in a display 62. Upon completing 92 a selection of a particular box 10, gift card 50, each individually, or a combination together, a user may complete 93 a purchase.

A user may then assemble 94 the gift box 10, including, in certain embodiments or configurations, placing the gift card 50 on the deck 40 of the gift box 10. In some embodiments, as described hereinabove, the gift card 50 may already be secured to the deck 40 of the box 10 and its retail packaging 52.

Ultimately, however, the final steps of assembling 94 are the province of the purchaser as the walls 24 are erected above the floor 26. The panel 20 is folded into the presentation configuration, wherein the anchor flap 32 and tuck flap 34 are both placed out of sight, presenting only the gift card 50 on the deck 40. By "converting," here, is meant the erection of the box, which has actually been manufactured and its components connected or assembled. To exist as, typically, an integral device having all its constituent parts already secured to one another, the box 10 is still not "fully converted" or configured in the gift box shape suitable for giving.

Thus, a user then folds 95 portions of the panel 20 into the base 12 of the box 10 to present the deck 40 that will hold a gift card 50 enclosed 96 by the box 10. Optionally, as indicated by the bracketed designation in the Figures, a user may apply 97 decorations 22 such as a ribbon, a bow, stickers, labels, gift tags, to/from gifting cards, or the like, as desired. Likewise, a user may fill 98 a greeting card, whether that greeting card is simply a to/from card or a more elaborate card, in order to introduce the gift card 50 or the gift represented by the box 10. Thereafter, a purchaser may deliver 99 the gift constituted by the gift card 50 and the presentation box 10.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus formed as a collapsible gift box comprising:

a base having a floor with walls, comprising front, back, and side walls, permanently secured thereto and interconnected to draw one another simultaneously between a first, stowed, position substantially parallel to the floor and a second, deployed, position substantially orthogonal thereto;

a lid, foldable with respect to, and hinging from, one of the front and back walls between a first position parallel thereto and folded thereacross to be adjacent the floor, a second position extending away from the floor, and a third position substantially parallel to the floor, and adjacent and perpendicular to the walls;

a closure foldable with respect to the lid between a first, open, position parallel to the lid and a second, closed, position substantially orthogonal thereto and secured to the other of the front and back walls;

a panel, folded to have an anchor flap, a tuck flap, and a deck therebetween, the deck being pivotable with respect to the anchor flap and the tuck flap;

the panel, wherein the anchor flap is permanently secured to an anchor wall of the walls;

the panel, wherein the tuck flap is configured to fold from a stowed position parallel to the floor to a deployed position substantially perpendicular thereto; and a securement on the deck and holding a gift secured to the deck.

2. The apparatus of claim 1, wherein the walls, lid, and closure are integral, continuous, and contiguous with one another in the stowed and the deployed configurations.

3. The apparatus of claim 2, wherein the walls, lid, and closure are integral, continuous, and contiguous at all positions between the stowed and the deployed configurations.

4. The apparatus of claim 3, wherein the anchor flap is permanently secured in the stowed position to contact one of the front and back walls in the deployed position absent any further securement materials therebetween.

5. The apparatus of claim 4, wherein the tuck flap is positioned against the other of the front and back walls in the deployed configuration.

6. The apparatus of claim 5, further comprising:

tabs connecting the walls to the floor and to one another in the stowed configuration and the deployed configuration; and the anchor flap, further being permanently captured against one pair of the tabs in the deployed configuration; and the tuck flap, further being retained against the other pair of the tabs in the deployed configuration.

7. The apparatus of claim 6, wherein the one pair of the tabs is connected to draw the panel toward perpendicularity with the floor upon movement of the walls from the stowed configuration top the deployed configuration.

8. The apparatus of claim 7, wherein the tuck flap and the anchor flap are sized to incline the deck by extending different depths from the floor and along a height of the walls.

9. An apparatus formed as a collapsible gift box comprising:

a base having a floor with walls, comprising front, back, and side walls, permanently secured thereto and interconnected to draw one another simultaneously between a first, stowed, position substantially parallel to the floor and a second, deployed, position substantially orthogonal thereto;

a lid, foldable with respect to, and hinging from, one of the front and back walls between a first position parallel thereto and folded thereacross to be adjacent the floor, a second position extending away from the floor, and a third position substantially parallel to the floor, and adjacent and perpendicular to the walls;

a closure foldable with respect to the lid between a first, open, position parallel to the lid and a second, closed, position substantially orthogonal thereto and secured to the other of the front and back walls;

a panel, folded to have an anchor flap, a tuck flap, and a deck therebetween, the deck being pivotable with respect to the anchor flap and the tuck flap;

the panel, wherein the anchor flap is permanently secured to an anchor wall of the walls;

the panel, wherein the tuck flap is configured to fold from a stowed position parallel to the floor to a deployed position substantially perpendicular thereto; and retail packaging comprising a transparent container and a header secured thereto, the retail packaging matching the retail packaging envelope of a gift secured to the deck.

10. The apparatus of claim 9, wherein the walls, lid, and closure are integral, continuous, and contiguous with one another in the stowed and the deployed configurations.

11. The apparatus of claim 10, wherein the walls, lid, and closure are integral, continuous, and contiguous at all positions between the stowed and the deployed configurations.

12. The apparatus of claim 11, wherein the anchor flap is permanently secured in the stowed position to contact one of the front and back walls in the deployed position absent any further securement materials therebetween.

13. The apparatus of claim 12, wherein the tuck flap is positioned against the other of the front and back walls in the deployed configuration.

14. The apparatus of claim 13, further comprising:

tabs connecting the walls to the floor and to one another in the stowed configuration and the deployed configuration; and the anchor flap, further being permanently captured against one pair of the tabs in the deployed configuration; and the tuck flap, further being retained against the other pair of the tabs in the deployed configuration.

15. The apparatus of claim 14, wherein the one pair of the tabs is connected to draw the panel toward perpendicularity with the floor upon movement of the walls from the stowed configuration top the deployed configuration.

16. The apparatus of claim 15, wherein the tuck flap and the anchor flap are sized to incline the deck by extending different depths from the floor and along a height of the walls.

17. An apparatus formed as a collapsible gift box comprising:

a base having a floor with walls, comprising front, back, and side walls, permanently secured thereto and interconnected to draw one another simultaneously between a first, stowed, position substantially parallel to the floor and a second, deployed, position substantially orthogonal thereto;

a lid, foldable with respect to, and hinging from, one of the front and back walls between a first position parallel thereto and folded thereacross to be adjacent the floor, a second position extending away from the floor, and a third position substantially parallel to the floor, and adjacent and perpendicular to the walls;

a closure foldable with respect to the lid between a first, open, position parallel to the lid and a second, closed, position substantially orthogonal thereto and secured to the other of the front and back walls;

a panel, folded to have an anchor flap, a tuck flap, and a deck therebetween, the deck being pivotable with respect to the anchor flap and the tuck flap;

the panel, wherein the anchor flap is permanently secured to an anchor wall of the walls;

the panel, wherein the tuck flap is configured to fold from a stowed position parallel to the floor to a deployed position substantially perpendicular thereto;

wherein the walls, lid, and closure are integral, continuous, and contiguous with one another in the stowed and the deployed configurations;

wherein the walls, lid, and closure are integral, continuous, and contiguous at all positions between the stowed and the deployed configurations;

wherein the anchor flap is permanently secured in the stowed position to contact one of the front and back walls in the deployed position absent any further securement materials therebetween; and wherein the tuck flap is positioned against the other of the front and back walls in the deployed configuration.

18. The apparatus of claim 17, further comprising:

tabs connecting the walls to the floor and to one another in the stowed configuration and the deployed configuration; and the anchor flap, further being permanently captured against one pair of the tabs in the deployed configuration; and the tuck flap, further being retained against the other pair of the tabs in the deployed configuration.

19. The apparatus of claim 18, wherein the one pair of the tabs is connected to draw the panel toward perpendicularity with the floor upon movement of the walls from the stowed configuration top the deployed configuration.

* * * * *